US007230410B1

(12) United States Patent
Jordan

(10) Patent No.: US 7,230,410 B1
(45) Date of Patent: Jun. 12, 2007

(54) ACCURATE HIGH-SPEED CURRENT SOURCES

(75) Inventor: Edward Perry Jordan, Kernersville, NC (US)

(73) Assignee: Analog Devices, Inc., Norwood, MA (US)

( * ) Notice: Subject to any disclaimer, the term of this patent is extended or adjusted under 35 U.S.C. 154(b) by 402 days.

(21) Appl. No.: 10/953,147

(22) Filed: Sep. 28, 2004

Related U.S. Application Data

(60) Provisional application No. 60/607,138, filed on Sep. 3, 2004.

(51) Int. Cl.
*G05F 3/16* (2006.01)

(52) U.S. Cl. ..... 323/313; 323/316; 327/538; 307/243

(58) Field of Classification Search ..... 323/282–288, 323/276, 272; 361/87, 89, 90; 330/149, 330/257, 252, 260; 307/108–110
See application file for complete search history.

(56) References Cited

U.S. PATENT DOCUMENTS

| | | | | |
|---|---|---|---|---|
| 4,912,427 | A * | 3/1990 | Rybicki | 330/257 |
| 5,666,045 | A * | 9/1997 | Grodevant | 323/282 |
| 6,414,932 | B1 | 7/2002 | Kaku et al. | 396/116 |
| 6,421,314 | B1 | 7/2002 | Maruyama | 396/116 |
| 6,721,261 | B2 | 4/2004 | Kaku et al. | 396/116 |
| 6,738,339 | B2 | 5/2004 | Gyo | 396/116 |
| 6,744,721 | B2 | 6/2004 | Kamioka et al. | 396/124 |

* cited by examiner

*Primary Examiner*—Rajnikant B. Patel
(74) *Attorney, Agent, or Firm*—Koppel, Patrick, Heybl & Dawson

(57) ABSTRACT

Current source embodiments are provided which generate an output current pulse whose initial and terminal slew rates are enhanced with initial and terminal generators that respectively provide an initial current pulse at initiation of the command signal and a terminal current pulse at termination of the command signal. Current source embodiments also include a correction generator that inserts correction currents to substantially correct Lambda current errors in the current sources.

20 Claims, 3 Drawing Sheets

ACCURATE HIGH-SPEED CURRENT SOURCES

CROSS REFERENCES TO RELATED APPLICATIONS

This application claims the benefit of U.S. Provisional Application Ser. No. 60/607,138 filed Sep. 3, 2004.

BACKGROUND OF THE INVENTION

1. Field of the Invention

The present invention relates generally to transistor current sources.

2. Description of the Related Art

Conventional current sources generally fail to provide high-speed pulses with short rise and fall times and well-controlled pulse levels. This failure is especially noted when driving inductive or capacitive loads.

SUMMARY OF THE INVENTION

The present invention is directed to current source embodiments that generate current pulses with high slew rates and controlled pulse amplitudes. The novel features of the invention are set forth with particularity in the appended claims. The invention will be best understood from the following description when read in conjunction with the accompanying drawings.

DETAILED DESCRIPTION OF THE INVENTION

Current source embodiments of the invention are particularly suited to generate high-speed current pulses with short rise and fall times (i.e., high slew rates) and well-controlled current amplitude levels. They may be used in various systems that require high-speed current pulses. For example, they are well suited to driving laser diodes that provide recording system signals (e.g., write, read and erase signals) in digital video disc/compact disc) (DVD/CD) recorders and computer optical disc drives.

Figure 1:
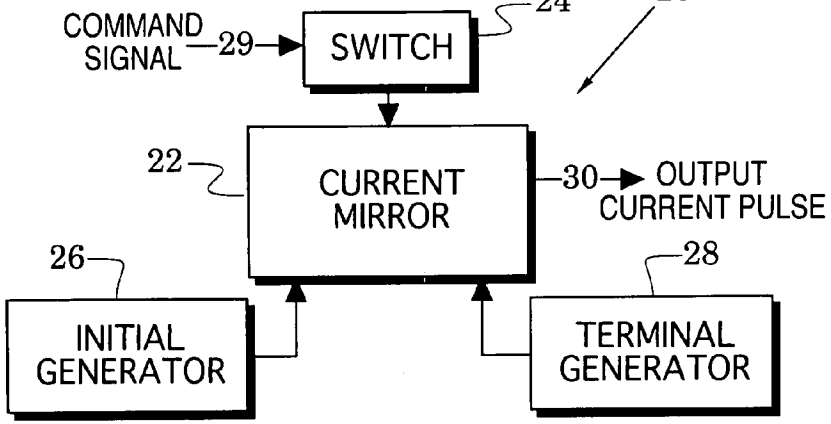
FIG. 1 is a block diagram of a current source embodiment of the present invention.

In particular, FIG. 1 illustrates a current source embodiment 20 that includes a current mirror 22, a switch 24 and initial and terminal generators 26 and 28. In response to a command signal 29, the switch operatively activates the current mirror during the duration of the command signal to thereby provide a current pulse exemplified by the output current pulse 30 in FIG. 2.

Figure 2:
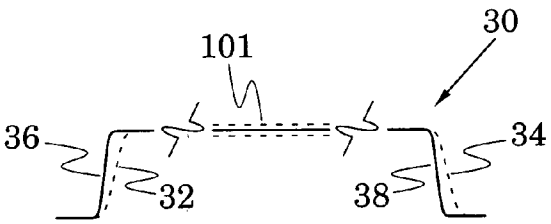
FIG. 2 is a diagram of a current pulse generated by the current source of FIG. 1.

The initial generator 26 is configured to provide an initial current pulse in response to the initiation of the command signal 29 and the terminal generator 28 is configured to provide a terminal current pulse in response to the termination of the command signal. FIG. 2 shows that the output current pulse 30 exhibits initial and terminal slew rates 32 and 34 (shown in broken lines). With application of the initial and terminal current pulses from the initial and terminal generators 26 and 28, the slew rates are significantly enhanced as shown by the slew rates 36 and 38.

Figure 3:
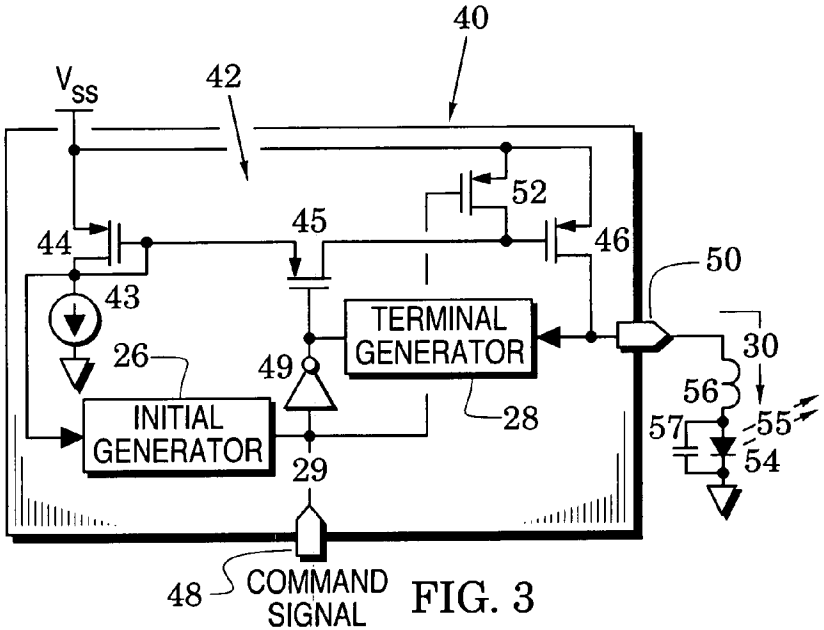
FIG. 3 is a diagram of another current source embodiment.

FIG. 3 illustrates a current source embodiment 40 that has a current mirror 42 formed of a diode-coupled current transistor 44, a mirror transistor 46 and a current source 43 coupled to the drain of the current transistor 44. The switch of FIG. 1 is realized with a switch transistor 45 that is inserted between the gates of the current and mirror transistors 44 and 46.

The command signal 29 is received at a command port 48 with an inverter 49 inserted between this port and the gate of the switch transistor 45. The initial generator 26 of FIG. 1 is coupled between the command port 48 and the drain of the current transistor 44 and the terminal generator 28 of FIG. 1 is coupled between the output of the inverter 49 and an output port 50. Finally, a control transistor 52 responds to the command signal at the command port 48 and is coupled between the supply $V_{ss}$ and the gate of the mirror transistor 46.

An exemplary current-source load is shown to be a high-speed laser diode 54 that emits light 55 in response to the current pulse 30 (first shown in FIG. 1). An inductor 56 is shown in series with the diode to represent stray inductance (e.g., due to circuit leads between the current source 40 and the diode 54. Various loads may also include stray capacitance as indicated by the shunt capacitor 57. Inductances and capacitances associated with the load generally degrade pulse rise and fall times.

In operation of the current source 40, the command signal (via the inverter 49) turns on the switch transistor 45 so that the current mirror 42 is activated and, accordingly, a current pulse 30 is driven through the laser diode 54 by the current transistor 46. The current of the current source 43 sets a gate-to-source voltage $V_{gs}$ in the current transistor 44 and this voltage is coupled (via the switch transistor 45) across the gate and source of the mirror transistor 46. In response, the mirror transistor generates the output current pulse with an amplitude determined by the ratio of the gate widths (W) of the mirror and current transistors 46 and 44.

Preferably, the switch transistor 45 has a wide gate and is driven with a substantial gate-to-source voltage so as to significantly reduce the resistance that it presents between the gates of the current and mirror transistors. Accordingly, the gate-to-source voltage $V_{gs}$ of the current transistor 44 is present at the gate of the mirror transistor 46 during the duration of the command signal 29 as shown in trace 62 of the graph 60 of FIG. 4. This pulse determines the duration of the output current pulse 30 that passes through the laser diode 54.

Figure 4:
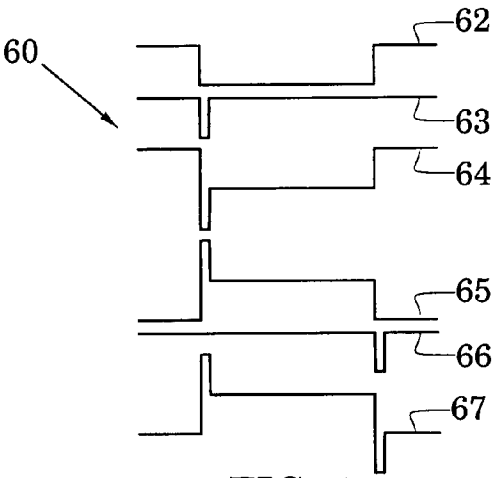
FIG. 4 is a diagram that illustrates voltage and current waveforms in the current source of FIG. 3.

In response to the initiation of the command signal, the initial generator 26 is configured to generate an initial current pulse with the current transistor 44 as shown in trace 63 of FIG. 4. Because of this initial increase in its drain current, the current transistor's gate-to-source voltage $V_{gs}$ exhibits a momentary pulse as shown in trace 64. In response to the gate-to-source voltage $V_{gs}$ of trace 64, the mirror transistor 46 inserts an initial current pulse so that its current pulse is altered to the pulse shown in trace 65. Because more current momentarily drives the load, the initial current pulse significantly enhances the initial slew rate of the output current pulse 30. For example, it is enhanced from the slew rate 32 in FIG. 2 to the slew rate 36.

When the command signal terminates, the switch transistor 45 again isolates the gates of the current and mirror transistors 44 and 46. To insure that the mirror transistor's gate-to-source voltage $V_{gs}$ is rapidly altered, the control transistor 52 is turned on by termination of the command signal to thereby pull the mirror transistor's gate up to the supply voltage $V_{ss}$. This enhances turnoff of the mirror transistor 46 and thereby enhances the turn-off slew rate of the output current pulse. Preferably, the control transistor 52 has a wide gate and is driven with a substantial gate-to-source voltage so as to significantly reduce the resistance that it presents between the supply $V_{ss}$ and the gate of the current transistor.

In response to termination of the command signal, the terminal generator 28 momentarily pulls a terminal current pulse from the output port 50 (and thus, from the load at this port) as indicated by trace 66 in FIG. 4. This action further alters the current at the port 50 from that shown in trace 65 to that shown in trace 67. Because more current is momentarily pulled from the load, the terminal current pulse significantly enhances the terminal slew rate of the output current pulse 30. For example, it is enhanced from the slew rate 34 in FIG. 2 to the slew rate 38.

The terminal generator 26 acts to rapidly remove additional charge from the load (e.g., from a highly inductive or capacitive load). This action significantly enhances the speed of the discharge time of the load with consequent increase of the current pulse's slew rate.

Conventional current sources typically degrade when driving highly inductive loads because of the inductive relationship V=L(di/dt). Current mirror transistors of these sources transition into their linear region when the compliance of the output device falls below the relationship $V_{ds}>V_{gs}-V_t$ (in which $V_{ds}$ is the transistor's drain-to-source voltage and which $V_t$ is the transistor's threshold voltage). The current source embodiments of the invention momentarily increase the current transistor's current so that the mirror transistor is overdriven during the slew period.

Figure 5:
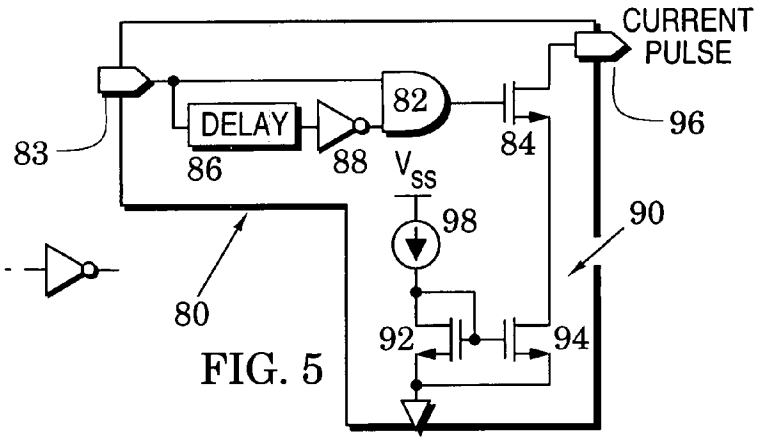
FIG. 5 is a schematic of a generator embodiment in the current source of FIG. 3.

FIG. 5 illustrates an embodiment 80 of the initial and terminal generators 26 and 28 of FIGS. 1 and 2. The generator embodiment 80 includes a gate 82 positioned between an input port 83 and the gate of a transistor 84. The input port is coupled to another input terminal of the gate 82 by a signal delay 86 and an inverter 88. Although the source of the transistor can be coupled to ground, additional control over its current is realized by coupling it to a current mirror 90 formed of a current transistor 92 that is coupled between a current source 98 and a mirror transistor 94.

In operation of the generator 80, the signal at the input port 83 is initially low so that the inverter 88 provides a high signal to the gate 82. A transition at the input port 83 to a high state thus causes the gate 82 to impart a turnon signal to the output transistor 84. When this transistor turns on, it passes the current of the current mirror 90 to an output port 96.

Figure 6:
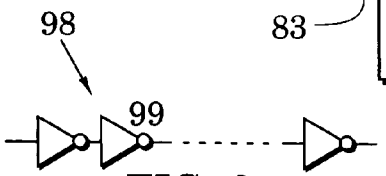
FIG. 6 is a delay embodiment in the generator of FIG. 5.

As soon as the input signal transitions the delay 86, the corresponding signal at the gate 82 drops. The output of the gate 82 drops and, in response, the output transistor 84 is turned off which terminates the current pulse at the port 96. FIG. 6 shows a string 98 of an even number of inverters 99 as one embodiment of the delay 86. Various other delay embodiments, such as a lowpass filter (formed, for example, with a resistor and capacitor network). The gate 82 and its associated delay 86 and inverter 88 form a network of a type sometimes referred to as a monostable multivibrator or, more commonly, a one-shot.

Conventional current mirrors have generally suffered from speed limitations and also from Lambda current errors that degrade control of the pulse amplitude. Metal-oxide-semiconductor (MOS) transistors, for example, exhibit a linear region and a saturation region. In the saturation region, drain current is preferably constant regardless of the magnitude of the drain voltage. In real life, however, this saturation current does vary and this variation corresponds to the Lambda value of the transistor which is a measure of the slope of the drain current versus increasing drain voltage.

Although the configuration of the current source 40 of FIG. 3 significantly enhances its speed, the output current of the current mirror 42 will vary if changes in a system parameter (e.g., changes in the supply voltage $V_{ss}$) alter the drain voltage on the mirror transistor 46. The resulting Lambda current error may cause the magnitude of the current pulse 30 through the laser diode 54 to vary more than is desirable. These pulse current amplitude variations are exemplified by the broken amplitude lines 101 in FIG. 2.

Figure 7:
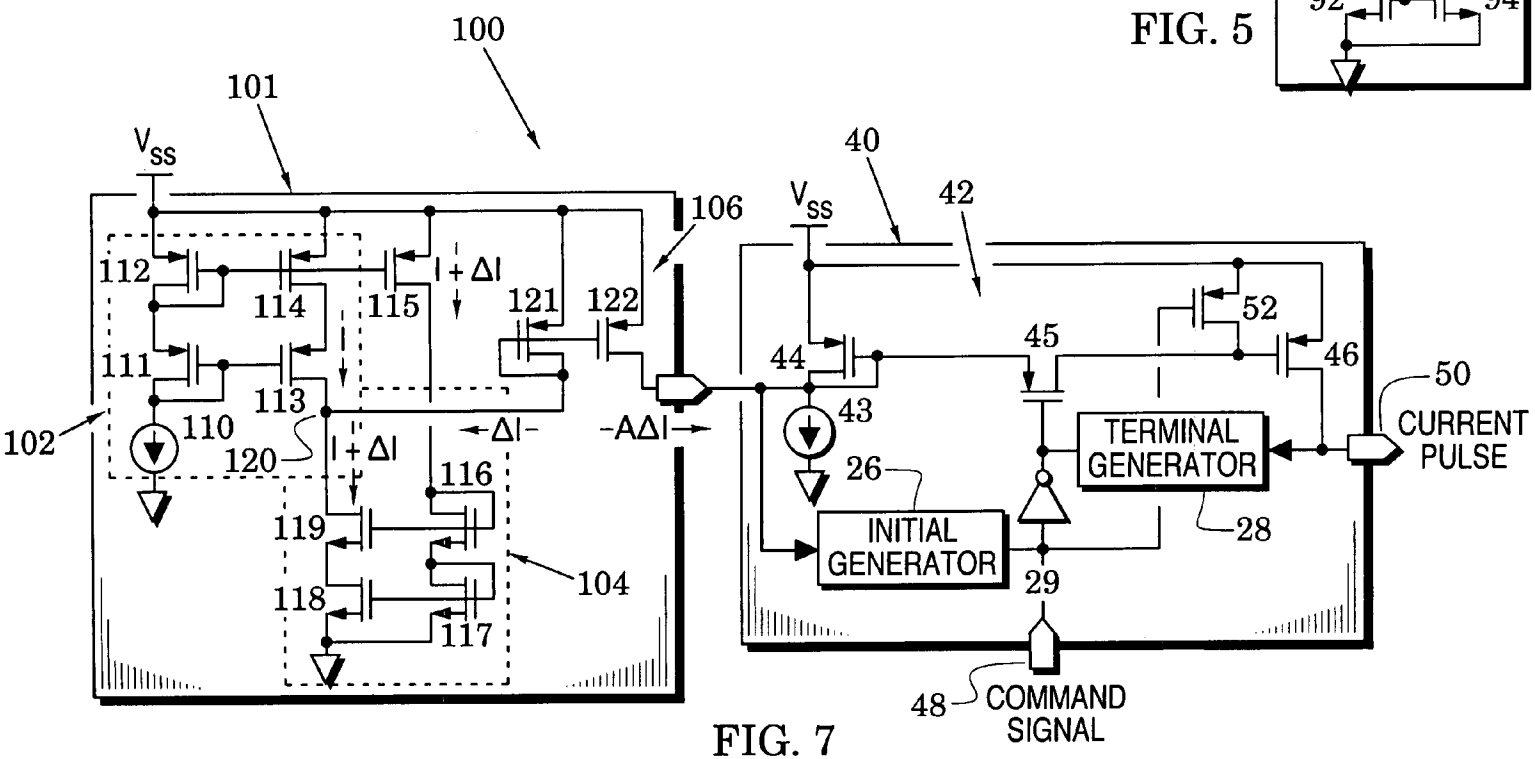
FIG. 7 is a diagram of another current source embodiment.

Lambda current errors may be reduced by lengthening the gate length L of appropriate devices (e.g., the mirror transistor 46) to thereby reduce the effect of varying drain voltages. This, however, reduces circuit speed of the current source. In contrast, FIG. 7 illustrates a current source embodiment 100 in which the current source 40 of FIG. 3 is supplemented by a Lambda correction network 101. The correction network 101 reduces Lambda current errors by providing a current to the current transistor 44 that is proportional to the Lambda current errors of the mirror transistor 46. The mirror transistor's current is thus altered to substantially reduce Lambda current errors without degrading the speed of the current source 100.

The correction network 101 includes a cascode current mirror 102, an error feedback loop 104 and an output current mirror 106. The cascode current mirror 102 is formed by a current source 110 in a series arrangement with diode-coupled transistors 111 and 112. Transistors 113 and 114 are arranged in a cascode arrangement and are respectively gate-coupled to transistors 111 and 112. Transistor 114 mirrors the current in current transistor 112 (which carries the current of the current source 110) to provide a reference current I at a network node 120. The cascode transistor 113 effectively stabilizes the drain voltage of the mirror transistor 114 so that there are essentially no Lambda current errors in the current I and it can serve as a reference current.

An error transistor 115 is also gate-coupled to the current transistor 112 and is provided with a load that preferably mimics the laser diode load (shown at the output port 50 in FIG. 3). In the correction network 101 of FIG. 7, this mimic load is formed by a series arrangement of diode-coupled transistors 116 and 117 (together, they generate a voltage drop on the order of 2.5 volts which approximates the voltage drop across an exemplary laser diode).

Because the drain voltage of the mirror transistor 115 is not stabilized, it not only mirrors the current I but also introduces a Lambda current error ΔI to generate a total mirrored current of ΔI+I. The error transistor 115 thus mimics the Lambda current error of the mirror transistor 46 in the current source 40. The error transistor 115 preferably has the same gate length as the mirror transistor 46 to enhance this mimicking action. The error feedback loop 104 includes the diode-coupled transistors 116 and 117 and also transistors 118 and 119 which are respectively gate-coupled to transistors 117 and 116. Transistors 118 and 119 thus mirror the current ΔI+I and, because the drain of transistor 119 is coupled to the network junction 120, they feedback this current so that it is differenced with the reference current I (from mirror transistor 114) to produce a correction current ΔI. The feedback loop 104 thus differences the reference current and the mirror current to provide the correction current.

Although the cascode current mirror 102 and error feedback loop 104 could be sized (via their gate widths W) to generate the desired current error, they are preferably sized significantly smaller to reduce the current drain of the current source 100. The generated error signal is then gained up in the current mirror 106 in which a current transistor 121 and a mirror transistor 122 are respectively sized to provide a current gain A. The mirror 106 thus provides a correction current AΔI which alters the current of the current transistor 44. This alteration is mirrored to the mirror transistor 46 to reduce its Lambda current errors. The current transistor 44, diode-coupled transistor 112, transistor 114 and error transistor 115 preferably have the same gate length as the mirror transistor 46 to enhance this error reduction.

Current source embodiments of the invention may be effectively used in a variety of applications. An exemplary application is in laser diode drivers which are needed in various recording systems such as high-speed DVD/CD recorders and computer optical disc drives. DVD/CD recorders are increasingly used in personal computers to burn (i.e., record) digital files (e.g., music and movie files and files from digital cameras and digital camcorders) onto optical discs. In these applications, speed and cost are key driving considerations.

Laser diode drivers convert voltage signals into current pulses which a laser then converts into corresponding light pulses that burn information onto an optical disc. They typically provide several levels of write currents and an associated read current. Slew rates are preferably fast enough to provide current pulse rise and fall times less than one nanosecond. The drivers typically include a low harmonic, switchable oscillator which provides a high-frequency signal (e.g., in the general range of 200 to 500 MHz) which is added to the read current pulses to suppress laser noise during the process of reading optical discs.

Figure 8:
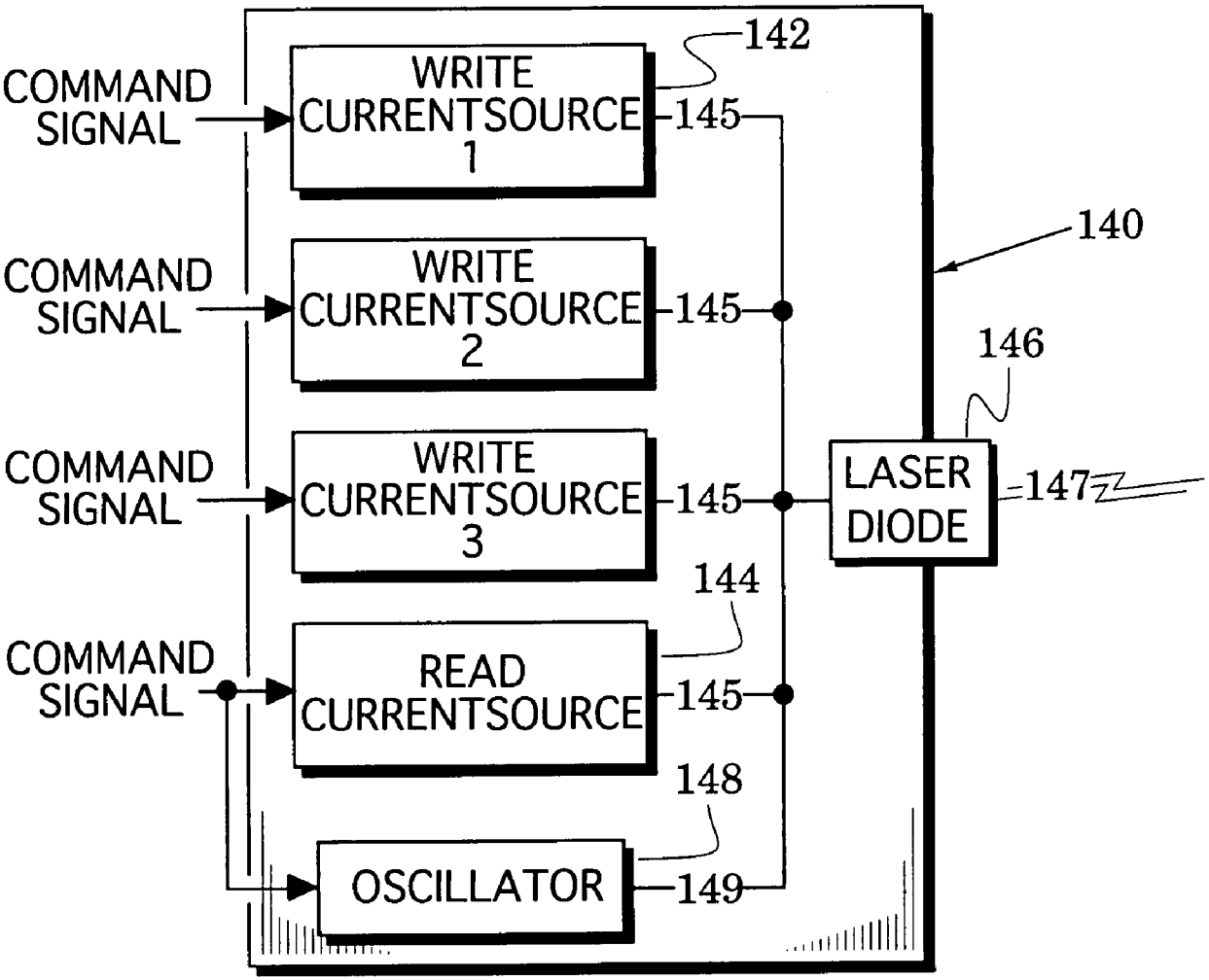
FIG. 8 is a block diagram of a laser diode driver embodiment that includes current sources embodiments of the invention

FIG. 8 illustrates a laser diode driver 142 in which the current source embodiments of the invention (e.g., the source 100 of FIG. 7) are used to form a plurality of write current sources 142 and at least one read current source 144 that generate current pulses 145 in response to command signals. The current pulses 145 of these current sources generally have durations in the range of 5-50 nanoseconds and are provided to a laser diode 146 which, in response, emits corresponding light pulses 147. An oscillator 148 is also included to provide a noise-reduction signal 149 to the laser diode.

The output current mirrors (e.g., mirror 42 in FIG. 7) of the write current sources 142 are preferably sized to deliver various minimum amplitude levels in the current pulses (e.g., 150, 250 and 325 milliamps) to accommodate different write functions (e.g., preheat, write and erase) in different recording systems. It is generally sufficient to provide a single read current source.

The disclosed current source embodiments are effective in reducing Lambda errors (changes in drain current induced by changes in drain voltages) in high speed current drivers (e.g., laser diode drivers) without slowing the current mirrors (which would result from the use, for example, of longer channel devices). These embodiments also enhance the current source rise and fall times without degrading their steady-state performance. They are especially useful in high current output stages where they enhance output slew rate.

Current mirror embodiments of the invention may be used to form a variety of useful systems such as laser driver systems. Although the embodiments are illustrated with reference to metal-oxide-semiconductor transistors (whose gates serve as control terminals), other embodiments may be formed with different transistors (e.g., bipolar junction transistors (whose bases serve as control terminals)).

The embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A current source that generates an output current pulse in response to a command signal, comprising:

a diode-coupled current transistor that carries a current;

a mirror transistor;

a switch that responds to a command signal and operatively activates said current and mirror transistors during the duration of said command signal to thereby provide an output current pulse from said mirror transistor; and at least one of an initial generator and a terminal generator wherein said initial generator is arranged to initiate an initial current pulse in said current transistor in response to the initiation of said command signal and said terminal generator is arranged to provide a terminal current pulse to said mirror transistor in response to the termination of said command signal;

whereby at least one of said initial and terminal current pulses enhance a slew rate of said output current pulse.

2. The source of claim 1, wherein said switch is a switch transistor that is arranged to couple control terminals of said current and mirror transistors during said duration.

3. The source of claim 2, wherein said control terminals are gates.

4. The source of claim 1, wherein at least one of said initial and terminal generators includes:

a signal delay that establishes a time period; and a pulse transistor that generates one of said initial and terminal current pulses in response to said signal delay.

5. The source of claim 4, wherein said time period is substantially less than said duration.

6. The source of claim 1, further including a control transistor coupled to alter the potential of a control terminal of said mirror transistor in response to said termination.

7. The source of claim 1, further including a current source coupled to said current transistor to provide said current.

8. The source of claim 1, further including a correction generator that provides a correction current to said current transistor.

9. The source of claim 8, wherein said correction generator includes:

a cascode current mirror that provides a reference current;

an error transistor coupled to said cascode current mirror to mirror a mirror current that includes an error current; and a feedback loop that differences said reference current and said mirror current to provide said correction current.

10. The source of claim 9, wherein said feedback loop is a cascode current mirror.

11. A current source that generates an output current pulse in response to a command signal, comprising:

a diode-coupled current transistor that carries a current;

a mirror transistor;

a switch that responds to a command signal and activates said current and mirror transistors during the duration of said command signal to thereby provide an output current pulse from said mirror transistor; and a correction generator that provides a correction current to said current transistor.

12. The source of claim 11, wherein said correction generator includes:

a cascode current mirror that provides a reference current;

an error transistor coupled to said cascode current mirror to mirror a mirror current that includes an error current; and a feedback loop that differences said reference current and said mirror current to provide said correction current.

13. The source of claim 12, wherein said feedback loop is a cascode current mirror.

14. The source of claim 11, further including:

at least one of an initial generator and a terminal generator wherein said initial generator is arranged to initiate an initial current pulse in said current transistor in response to the initiation of said command signal and said terminal generator is arranged to provide a terminal current pulse to said mirror transistor in response to the termination of said command signal;

whereby at least one of said initial and terminal current pulses enhance a slew rate of said output current pulse.

15. The source of claim 14, wherein at least one of said initial and terminal generators includes:

a signal delay that establishes a time period; and a pulse transistor that generates one of said initial and terminal current pulses in response to said signal delay.

16. The source of claim 11, further including a control transistor coupled to alter the potential of a control terminal of said mirror transistor in response to termination of said command signal.

17. The source of claim 11, further including a current source coupled to said current transistor.

18. A laser diode driver, comprising:

at least one write current source that provides an output current pulse in response to a first command signal;

at least one read current source that provides an output current pulse in response to a second command signal;

an oscillator that provides a noise-reduction signal in response to a third command signal;

wherein at least one of said write current source and said read current source includes:

a) a diode-coupled current transistor that carries a current;

b) a mirror transistor;

c) a switch that responds to one of said command signals and activates said current and mirror transistors during the duration of said command signal to thereby provide said output current pulse from said mirror transistor; and d) at least one of an initial generator and a terminal generator wherein said initial generator is arranged to initiate an initial current pulse in said current transistor in response to the initiation of said command signal and said terminal generator is arranged to provide a terminal current pulse to said mirror transistor in response to the termination of said command signal;

whereby at least one of said initial and terminal current pulses enhance a slew rate of said output current pulse.

19. The driver of claim 18, further including a correction generator that provides a correction current to said current transistor.

20. The driver of claim 19, wherein said correction generator includes:

a cascode current mirror that provides a reference current;

an error transistor coupled to said cascode current mirror to mirror a mirror current that includes an error current; and a feedback loop that differences said reference current and said mirror current to provide said correction current.

* * * * *